United States Patent [19]

Brandt

[11] Patent Number: 4,574,702

[45] Date of Patent: Mar. 11, 1986

[54] ARMOUR-PIERCING HIGH-EXPLOSIVE PROJECTILE WITH CARTRIDGE

[76] Inventor: Francois Brandt, Chalet Le Caribou, 1884 Villars sur Ollon, Vaud, Switzerland

[21] Appl. No.: 539,030

[22] Filed: Oct. 4, 1983

[30] Foreign Application Priority Data

Oct. 8, 1982 [FR] France ..... 82 16942

[51] Int. Cl.[4] ..... F42B 11/22

[52] U.S. Cl. ..... 102/476; 102/244; 102/439; 102/272

[58] Field of Search ..... 102/306–310, 102/475, 476, 241, 242, 244, 231, 237, 235, 374–381, 272, 364, 275, 430, 529, 439

[56] References Cited

U.S. PATENT DOCUMENTS

| | | | |
|---|---|---|---|
| 1,689,470 | 10/1928 | Adelman | 102/235 |
| 2,330,636 | 9/1943 | Smith | 102/272 |
| 2,490,389 | 12/1949 | Wales, Jr. | 102/235 |
| 2,697,400 | 12/1954 | Liljegren | 102/476 |
| 2,700,934 | 2/1955 | Thompson | 102/235 |
| 2,741,180 | 4/1956 | Meister | 102/476 X |
| 2,764,092 | 9/1956 | Massey | 102/476 X |
| 2,773,448 | 12/1956 | Jasse | 102/379 |
| 2,870,714 | 1/1959 | Weller | 102/237 |
| 2,910,000 | 10/1959 | Brandt | 102/476 |
| 3,177,809 | 4/1965 | Russell-French | 102/430 |
| 3,633,512 | 1/1972 | Schlack et al. | 149/44 |
| 3,903,802 | 9/1975 | Squiers . | |
| 3,981,241 | 9/1976 | Ambrosini et al. | 102/380 |
| 4,167,140 | 9/1979 | Biserod | 102/364 |
| 4,242,964 | 1/1981 | Warren et al. | 102/275 |
| 4,497,253 | 2/1985 | Sabranski | 102/476 |

FOREIGN PATENT DOCUMENTS

| | | | |
|---|---|---|---|
| 858949 | 10/1952 | Fed. Rep. of Germany . | |
| 1149810 | 1/1958 | France . | |
| 1161445 | 8/1958 | France | 102/308 |
| 1428448 | 12/1966 | France . | |
| 2286364 | 4/1976 | France | 102/529 |
| 2382671 | 11/1980 | France . | |
| 23733 | of 1914 | United Kingdom | 102/244 |

*Primary Examiner*—Harold J. Tudor

*Attorney, Agent, or Firm*—Beveridge, DeGrandi & Weilacher

[57] ABSTRACT

On impact the primer (37) is struck by the point (33) and transmits the ignition to an explosive column (14) located in the hollow nose (4). The splinters from a metal closing piece (17) are then thrown violently into an empty duct (19) located along the center line of the high-explosive filling (23, 24) made of stabilized secondary explosive material. When the projectile has been fired it is driven in rotation in order to stabilize it and the bolt (27) subjected to centrifugal force frees the way along the duct (19). The splinters from piece (17) can therefore travel through the duct (19) and strike the ignition booster (22) which is also made of stabilized secondary explosive material. The hollow charge is formed by the conical piece (11).

A highly effective projectile is produced having great operational safety.

24 Claims, 6 Drawing Figures

ARMOUR-PIERCING HIGH-EXPLOSIVE PROJECTILE WITH CARTRIDGE

The object of this invention is an armour-piercing high-explosive projectile or shell with cartridge which can be used in particular in a shoulder-borne light individual weapon with rifled bore enabling excellent results to be obtained in straight trajectory fire against point objectives like antitank weapons even when protected by shielding, helicopters flying at low altitude or slightly or lightly armoured personnel transport vehicles like so-called VTT's. Such a weapon fitted with a long-travel recoil brake which absorbs the major part of the recoil energy, using a projectile according to the invention, can be handed out to infantry to the extent of a few items per company, thus substantially increasing its fire power and its means of action without reducing its mobility.

Conventional type armour-piercing high-explosive projectiles are fitted with a detonator device generally comprising a so-called primary explosive material, i.e. one that can be ignited by the action of a relatively low-energy impact when the projectile hits the target. In some of these projectiles of known type, the detonator comprising the primary high-explosive charge is located actually inside the high-explosive filling which in fact consists of a stabilized secondary explosive. This leads to high accident risks in the case of inadvertent ignition of the detonator. In some other projectiles of known type the detonator is removable and fitted outside the secondary explosive filling, with means being provided to move the detonator inside the secondary explosive filling after firing. It can be understood that such safety devices are therefore extremely complex.

This invention enables an armour-piercing high-explosive cartridge to be produced which has important qualities with respect both to safety of utilization and efficiency. The projectile according to the invention provides an extremely simple solution to the problem of operating safety. Furthermore the construction of the projectile enables the weights to be better distributed by permitting a low overall length and an advantageous ballistic shape having a relatively short cylindrical portion thus reducing the loss of speed in flight.

The projectile according to the invention also makes it possible to obtain stabilization on the projectory with a low rifle pitch, a relatively high muzzle velocity for limited recoil and enables low propellent pressures of around 400 to 600 bars to be used.

The projectile of the invention allows a large number of splinters to be sprayed around at high speed; the range of these sprayed splinters is nevertheless cut down, which has the advantage of not exposing the troops close to the impact. Furthermore, the light weight of the projectile according to the invention allows the crewman to carry a large amount of ammunition thus increasing the number of rounds he has available. Finally the projectile according to the invention comprises a self-destruct device acting quickly, for example after about two seconds, following the firing of the round.

The armour-piercing high-explosive projectile with cartridge according to the invention comprises a body fixed to the cartridge case and fitted with gyrational stabilization means engaging with a rifled gun tube, a nose piece which is fixed to the body and a nose fuze. The projectile contains a flat charge, a high-explosive charge and means of firing the explosive charge on impact. In the invention the projectile comprises an empty duct located along the centre line of the high-explosive filling and comprising safety blocking means. The duct is open at its front end and joins up to the high-explosive filling at its rear end. An explosive column located along the centre line of the nose and of the hollow structure is closed at its back end by a metal piece. The projectile fuze comprises a primer of primary explosive material capable of igniting the explosive material of the said column on impact. The high-explosive filling consists exclusively of stabilized secondary explosive material so that the body of the projectile according to the invention comprises no other primary explosive material even after the round has been fired.

It is known that a stabilized explosive mass, which it is appropriate to call a secondary explosive material, is not ignited when a bullet passes through it. However, it has been observed that when a projectile is sent at a much higher speed, about twice the speed of such a bullet, it is capable of causing an explosion when it strikes the secondary explosive material even if there is no primary explosive material present. The invention is therefore based on the application of this phenomenon; ignition of the high-explosive filling consisting only of stabilized secondary explosive material is caused by the splinters of the metal piece closing the rear end of the explosive column, which splinters are violently thrown through the empty duct located along the centre line of the high-explosive filling. The metal piece closing the explosive column preferably has a concave profile facing the front end of the duct for this purpose.

The safety blocking means preferably comprise a radial cavity inside which a bolt is mounted which is acted on by a closure spring and can block the duct. The centre of gravity of the bolt in the closing position is on the same side of the projectile centre line as the said cavity, so that gyration of the projectile round its centre line leads to the bolt opening and freeing the duct. With this extremely simple system it is possible to achieve great safety in utilization of the projectile according to the invention since, before firing of the round leading to gyration of the projectile, the axial duct is completely blocked by the above-mentioned bolt. Inadvertent firing of the explosive column leading to bursting of the closing metal piece does not therefore risk igniting the high-explosive filling of the projectile, since the debris of the metal piece are stopped by the bolt and cannot reach the high-explosive filling.

The radial cavity inside which the safety blocking bolt moves is advantageously made inside an annular collar comprising a plurality of radial holes which enable the said collar to be made lighter. The empty axial duct is preferably made in a component which forms an integral part of the said collar.

In order to improve firing of the high-explosive filling, there is a primer booster consisting of stabilized secondary explosive material which is preferably located at the rear end of the duct so that it can be struck by the splinters from the metal closure piece thrown through the above-mentioned axial duct to ignite the high-explosive filling of the projectile. This filling preferably consists of two high-explosive cakes of revolution, having an overall annular shape, which can be stacked round the axial duct and partly separated by the annular collar of the safety locking device.

The flat charge of the projectile of the invention preferably consists of a liner having an overall conical shape with a large vertex angle which is installed round the front end of the axial duct inside the projectile body. With the projectile body and outside walls of the said axial duct the liner bounds the cavity enclosing the projectile's high-explosive filling.

The edge of the conical liner forming the hollow charge preferably is knurled or has some other equivalent means of increasing the frictional torque between the liner and the projectile body to prevent any relative rotation during the high rotational acceleration on departure of the round.

The projectile of the invention also comprises an instantaneous impact nose fuze. According to a first variant, the nose fuze comprises, inside a thin-walled nose cap, a squash plate fitted with a point-shaped component installed by means of a deformable element so as to be capable, on impact, of striking a primer which causes ignition of the projectile's explosive column.

In another embodiment the nose fuze has an axial bar of hard material, for example metal carbide, also placed inside a thin-walled nose cap, fitted inside a collar connected to a point-shaped component by a thin connecting ring. This ring can be sheared on impact on a hard obstacle. By means of the above-mentioned bar, the point-shaped component is then separated from the collar and strikes the primer and ignites the explosive column. If the projectile strikes a soft obstacle, the explosive column is ignited by the primer by the point-shaped component which remains fixed to the above-mentioned collar which is installed by means of a deformable component so that it can be moved on impact until the point strikes the primer.

The projectile of the invention also comprises a cartridge case fitted with a primer made of primary explosive material which can be fired by the firing pin of the weapon using the projectile and transmit the explosion to a propellent charge installed inside the cartridge thus firing the round. The projectile's body comes off the cartridge in the conventional manner; the cartridge remains in the breech or in the cartridge chamber acting as the breech of the weapon being used. Although it is light and made for, example, from light metal like duralumin, the cartridge case used has, however, a thick enough base to provide sufficient strength when the projectile is used in a lightweight weapon in which the breech proper is replaced by a round locking mechanism mounted in a cartridge chamber open to the back.

The projectile of the invention preferably comprises a self-destruct charge located outside the end face of the projectile body and capable of causing the high-explosive charge to ignite after a delay.

In an advantageous embodiment the projectile according to the invention also comprises a boosted or rocket propulsion container containing a second solid fuel motor installed between the projectile body and the cartridge case. The rocket propulsion container is fitted at the back with an exhaust nozzle having a convergent-divergent profile. The solid fuel contained in the rocket propulsion container advantageously comprises a cylindrical cake provided with a central hole having a star-shaped cross-section. A booster charge which may consist, for example, of a small cake of compressed powder can be ignited by the propellent charge of the cartridge and is installed close to the exhaust nozzle so that it transmits the flames through the central opening of the fuel cake up to the solid fuel located in the rocket propulsion container, so igniting the latter.

The present invention will be more clearly understood on studying the detailed description of several embodiments taken as non-restrictive examples and illustrated in the appended drawings, in which.

Figure 1:
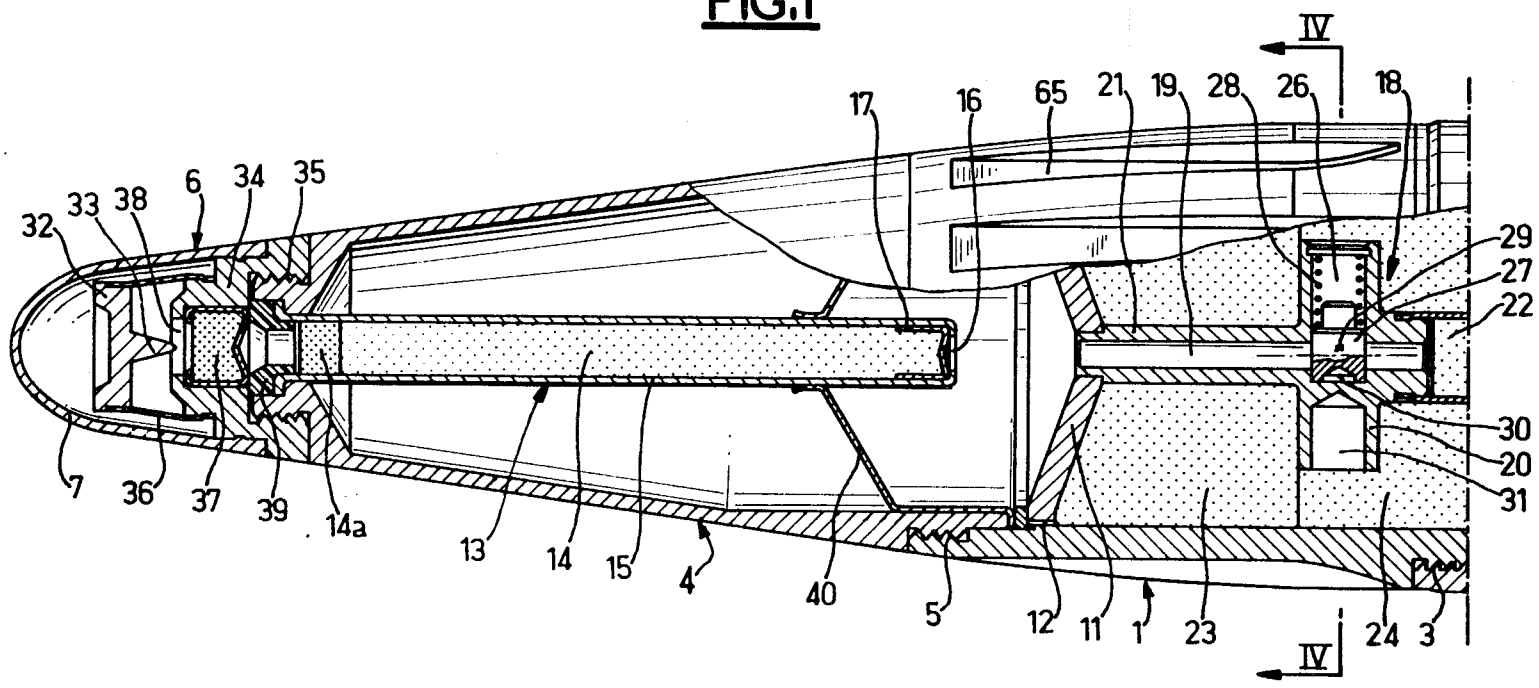
FIG. 1 is a part section view of a first embodiment of a projectile according to the invention, showing the front part of this projectile.
Figure 2:
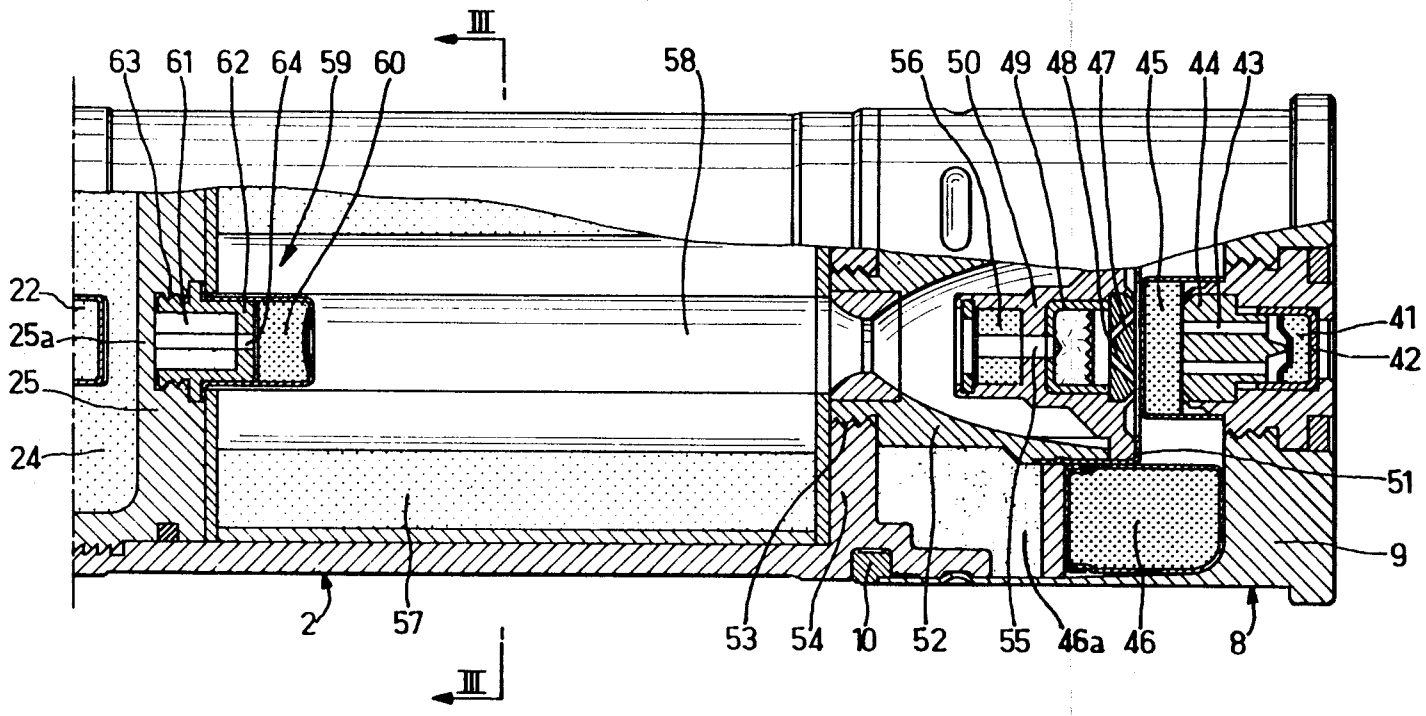
FIG. 2 is a section view showing the rear portion of the same projectile comprising, in particular, a rocket-propulsion or self-propulsion container.

As shown in FIGS. 1 and 2 the armour-piercing high-explosive cartridge according to the invention comprises a body 1 having a general cylindrical shape fixed to a self-propulsion container 2 also of an overall cylindrical shape by means of a thread 3. Towards the front of the projectile the body 1 is fixed to a hollow nose 4, which has an overall thin-walled conical form, by means of a thread 5. At the front end of the projectile there is a nose fuze 6 fitted with a thin-walled nose cone 7.

The projectile is completed, close to its rear end, by the cartridge 8 the bottom of which has a relatively large thickness compared with its cylindrical wall crimped onto the back of the container 2. The projectile can be inserted into the breech or into the cartridge chamber of an individual weapon having a rifled gun barrel. A copper band 10 engages with these riflings in order to stabilize the projectile by gyration when it leaves the gun barrel. A liner 11 of overall conical shape with a wide vertex angle and concave towards the front acts as the flat charge. The liner 11 is fitted close to the front of the body 1 and it has, round its edge, knurling 12 enabling correct rotation of the liner to be guaranteed during propulsion of the projectile inside the rifled gun barrel. The knurling 12 on the liner 11 made of steel, for example, is in fact impressed on assembly into the bore of the body 1 which is made of light metal of the magnesium or anti-corrodal type. Inside the hollow nose 4 and on the centre line of the nose an explosive column 13 is installed which contains stabilized secondary explosive material 14 inside a cylindrical tubular sheath 15 the open rear end of which 16 is closed by a metal closing element 17 having a concave profile facing the rear. At its front end the column 13 comprises a disc 14*a* consisting of primary explosive facilitating transfer of the ignition to the secondary explosive 14.

Inside the body 1 and along the body centre line there is a centrifugal action safety device fitted marked 18 overall. The device 18 has an empty axial duct 19 running through the liner 11 and an annular collar 20 which can also be seen in section in FIG. 4. The outside wall 21 of duct 19 is fixed at its front end to the hollowed out centre of the liner 11. At its rear end the duct 19 connects with a primer booster 22 comprising a stabilized secondary explosive material.

The projectile's high-explosive filler designed to blow forward, on impact, the liner 11 forming the hollow charge comprises two circular shaped explosive cakes 23 and 24 having an overall annular shape and stacked round the ouside wall 21 of the duct 19 partly separated by the annular collar 20. As can be seen in FIG. 1 the high-explosive charge formed by the two cakes 23 and 24 of stabilized secondary explosive material is therefore housed inside a cavity which is bounded inside the body 1 and bounded at the front by the liner 11 and at the rear by the end 25 of the body 1. The empty duct 19 is located along the centre line of the high-explosive filler 23, 24 and the ignition booster 22 is buried inside the explosive cake 24.

The annular collar 20 has a radial cavity 26 which extends beyond the centre line of the duct 19 and inside which is fitted a cylindrical bolt 27 which is pressed in the direction of the centre line by a spring 28 bearing against the bottom of the cavity 26. The cylindrical bolt is constructed in such a manner that its centre of gravity 29 in the closed position illustrated in FIG. 1 is located on the same side of the projectile centre line as the bottom of the cavity 26. This result can be achieved for example by making a blind hole 30 in the bolt 27. Under these conditions it will be understood that gyration of the projectile round its axis leads to a centrifugal force acting on the bolt mass 27 which therefore compresses the spring and enters the cavity 26 so opening the duct 19 which it blocked completely when the projectile was not being driven in rotation.

Figure 4:
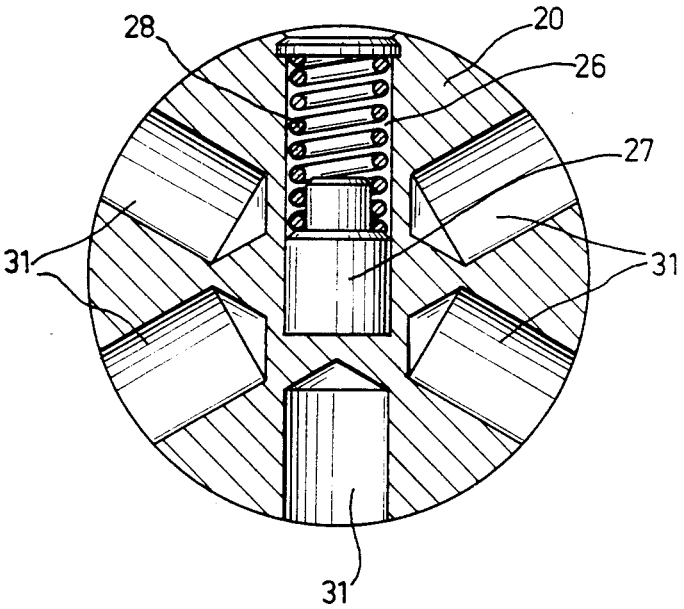
FIG. 4 is a section view along IV—IV of FIG. 1 showing the annular collar comprising the safety blocking bolt.

In order to lighten the projectile and prevent any weight eccentricity during gyration, the annular collar 20 also comprises five radial holes 31 which can also be seen in FIG. 4.

The rear end of the explosive column 13 comprising the concave metal piece 17 is located some distance from the front opening of the duct 19 as can be seen in FIG. 1. Owing to the axial installation of the explosive column 13 and the empty duct 19, the firing of the explosive column 14 causes metal splinters from the piece 17 to be thrown off and enter the duct 19; these splinters are capable, when the bolt 27 has freed the duct 19, of leading to explosion of the ignition booster 22 and to ignition of the high-explosive charge 23, 24.

The nose fuze 6 comprises, inside the thin-walled nose cone 7, a squash plate 32 provided with a point-shaped component 33. The plate 32 is installed on an intermediate component 34 made of light metal and fixed by a thread 35 to the front end of the nose 4. The squash plate 32 is fitted some distance in front of the intermediate element 34 by means of a light metal press-formed deformable skirt 36. A primer 37 is placed on the centre line of the intermediate element 34 and has a front part which can be struck by the tip 33 through the passage 38 in the intermediate element 34 on impact by the projectile.

A packing sleeve 39 is placed between the intermediate element 34 and the folded outer edge of the sheath 15 of the explosive column 13 which bears against a shoulder on the front portion of the nose 4. Under these conditions the explosive column is properly positioned inside the nose 4 by its front end when the intermediate element 34 is screwed on and close to its rear end by means of a support 40. It will be noted that the intermediate element 34 and the other components of the nose fuze 6 like the squash plate 32 bear against the sleeve 39 which is made, for example, from plastics material. These circumstances mean that if the explosive 14 expands this can move slightly axially inside its sheathing tube 15. The flexibility of the sleeve 39 therefore means that it is possible to take up the heat expansion differences between the sheath 15 and the explosive 14.

Figure 3:
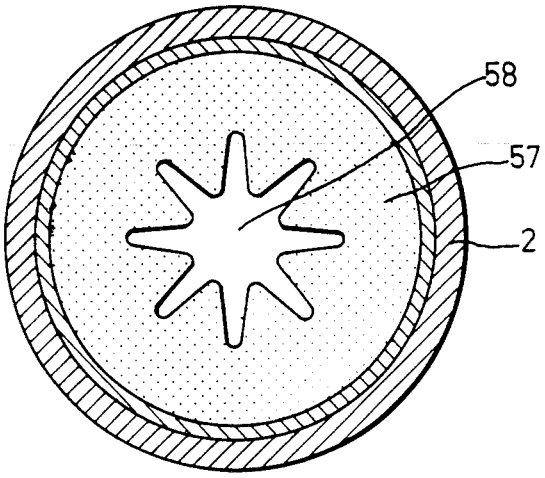
FIG. 3 is a section III—III of FIG. 2 showing the structure of the solid fuel contained in the rocket propulsion container.

Referring to FIG. 2, it can be seen that the cartridge case 8 of the projectile contains a primer 41 of primary explosive material covered by a cap 42 which can be struck by the firing pin of the weapon using the projectile. The flames from the primer 41 are transmitted via the holes 43 in an intermediate piece 44 to a booster powder charge 45 which transmits the ignition to the propellent charge 46 which comes in the shape of an annular cake installed inside the cartridge case 8 between the end wall 9 and an annular wad 46a. The fire from the propellent charge 46 and from the booster charge 45 is again transmitted by the holes 47 in a spacer element 48 to a compressed booster powder cake 49 installed on the centre line of the cartridge case 8 inside a light metal support 50 held in place by a pressing 51 against the outer front face of the exhaust nozzle 52 having a convergent-divergent profile which is fixed by screwing, using the thread 53, onto the end 54 of the container 2. Instantaneous firing of the powder 49 transmits the ignition after a certain time span (after the projectile has left the barrel of the weapon used) through the orifice 55 to another annular booster 56 also fitted in support 50 close to its front end and which is located, as can be seen from FIG. 2, inside the divergent portion of the nozzle 52. The booster 56 projects a flame through the duct 58 and ignites a powder charge 60. As soon as the projectile has left the gun barrel of the weapon used the powder charge 60 is therefore able to ignite the rocket propulsion charge 57 installed inside the rocket propulsion container 2. As can be seen in the section in FIG. 3 in particular the rocket propulsion charge 57 has an empty axial duct with a star-shaped cross-section 58.

A self-destruct device, marked 59 as a whole, is installed inside the duct 58 in the end 25 of the body 1. This self-destruct device notably comprises the powder charge 60 which is capable of igniting a charge 61 of powder filled with aluminium or magnesium in such a way as to produce a mixture which burns very exothermically. The charge 61 has an annular structure and is installed inside the support 62 screwed by the thread 63 in the end 25. Combustion of the charge 61 gradually heats up the end wall 25. When the temperature of this wall reaches a pre-set limit which is above 250° C., the high explosive filling 24 in contact with this wall begins to detonate. The transmission of heat through the wall 25 therefore makes it possible to achieve self-destruction after a delay of any projectile which may not have exploded by impact on the nose fuse.

It will be noted again that in the slightly conical front section of the body 1 the outer edge of the projectile has axial milled slots 65 which are capable of gradually slowing down the rotation of the projectile on its flight by aerodynamic action.

Figure 5:
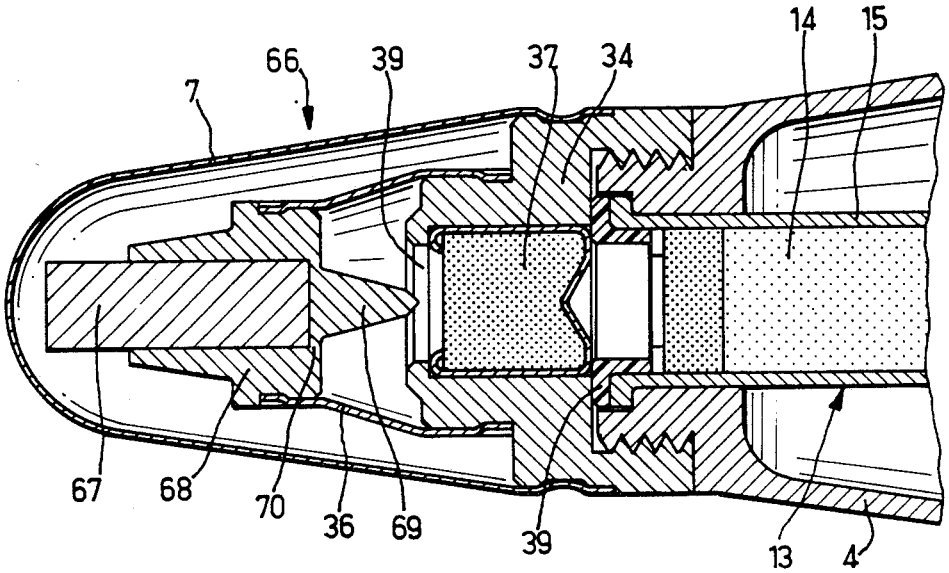
FIG. 5 is a section view of a variant of the nose fuze which can be used on a projectile according to the invention.

FIG. 5 illustrates a variant for a nose fuse 66 which can be used on a projectile according to the invention. In this figure the same pieces carry the same reference numbers. We find inside the thin-walled nose cap 7 the intermediate support 34 and the primer 37. In this variant an axial bar made of hard material, for example of metal carbide, numbered 67 is installed inside a collar 68 having a point 69. The assembly of the collar 68 fitted with the bar 67 and the point 69 is installed by means of a deformable pressing 36 so that the point 69 is a short distance from the primer 37. At the join between the point 69 and the body of the collar 68 the material of the collar 68 is thinned in the form of a thin connecting zone 70.

Under these conditions the bar 67 of hard material is capable of shearing off the connecting zone 70 on impact on a hard obstacle, thus driving the point 69 which then strikes the primer 37 without the element 36 being deformed.

On the contrary, at impact on a sort obstacle, it is the whole of the collar 68, including the bar 67, which is displaced and deforms component 36 until the point 69 strikes against the primer 37.

Under these conditions, the striking head comprising the hard bar 67 means that it is possible to make sure of operation at a high incidence of impact on a hard obstacle through shearing of the weakened connecting zone 70 of the collar made in light metal, for example made of anticorrodal. In the case of a soft obstacle the operation is the same as for the nose fuse illustrated in FIG. 1.

It will be noted that the collar 68 has an outer surface about 5 times greater than the surface area of the front end of the hard bar 67.

Figure 6:
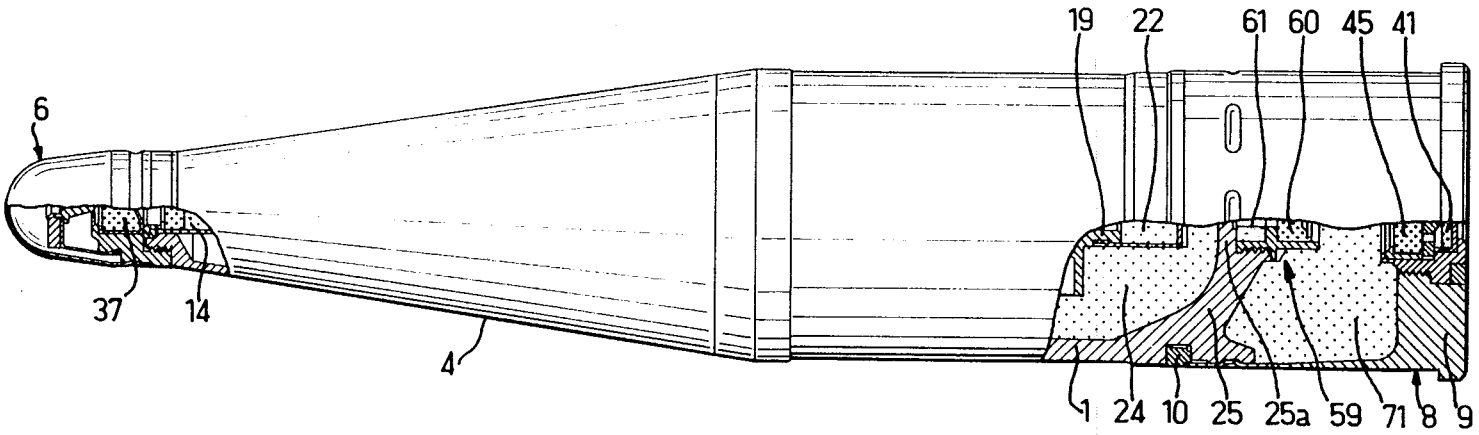
FIG. 6 is a part section view of a second embodiment of a projectile of the invention not comprising any rocket propulsion container.

FIG. 6 illustrates a projectile variant which does not contain a rocket propulsion charge capable, as in the case of the embodiment in FIGS. 1 and 2, of providing extra speed on leaving the gun barrel.

Apart from this difference the principle of the powder train transmission from the primer 37 located inside the nose fuse 6 via the explosive column 14 up to the main high-explosive filling 24 is identical. Identical components carry the same reference numbers. Because these features are identical the main part of the projectile has been shown in FIG. 6 as seen from the outside.

As can be observed from FIG. 6 we find the propellent charge 71 in the cartridge case 8, this charge having an overall cylindrical shape and being fired by means of the booster charge 45 after transmission of the flames from the primer 41. We also find the self-destruct device 59 located on the centre line of the propellent charge 71 and fixed to the end 25 of the body 1.

Whether the projectile is of the simple type shown in FIG. 6 or is combined with a rocket propulsion container as shown in FIGS. 1 and 2 to produce extra velocity, in all cases we obtain an armour-piercing, high-explosive projectile possessing great efficiency and great operational safety. This high efficiency is a result of the combination of accuracy, lightness, high muzzle velocity, large high-explosive content and the armour piercing capacity which is the result of these.

The objectives for which a weapon using such a projectile is designed are located at only a few hundred meters away, whether they are fixed or mobile. The remarkably light projectile of the invention, in comparison with its calibre, provided with a considerable high-explosive capacity, owing to its flat charge, makes it possible to pierce relatively thick and strong armour-plating. The pyrotechnic train which is fitted in the projectile, and which comprises the explosive column 14 in particular, provides extremely rapid transmission of ignition immediately on impact. The impact velocity may be evaluated at between 600 and 200 m/sec. Thanks to the high speed of pyrotechnic transmission the splinters from the concave shaped end piece 17 are thrown, virtually on impact, through the empty axial duct 19 which runs along the centre line of the high-explosive filling 23,24 and very violently hits the primer booster 22 containing secondary charge exlusively. It is thus possible to prevent any dangerous primray explosive from being present inside the high explosive filling itself. The velocity of the metal fragments of part 17 is of the order of 1500 m/sec. The physical barrier formed by a simple bolt 27 retracting laterally under the effect of centrifugal force makes it possible to provide high operational safety in an extremely simple way.

The liner 11 forming the armour-piercing projectile's flat charge is then propelled at great speed by the high explosive filling 23, 24. The high speed of pyrotechnic transmission combined with the short length of the duct 19 enables the high-explosive filling 23, 24 to be ignited while the liner 11 is still far enough away from the target so that it conserves its full armour-piercing effect.

The hollow nose cap 4 of the projectile and also its body 1 and the container 2 can be made of magnesium which means that a significant weight saving can be obtained along with an incendiary effect on impact.

It can be seen that the construction of the projectile according to the invention means that it does not need a conventional detonator containing sensitive primary material which is needed by the conventional primer system. In addition, the projectile of the invention means that the detonator does not need to be located inside the filling, with all the risks that that implies. Nor is it necessary, as is usually the case, to use a detonator outside the filling which is moved after departure of the round. Finally, the projectile according to the invention makes it possible to provide safety in a very simple manner for a round with a flat charge and an instantaneous percussion nose fuse. Indeed, in the case of inadvertent operation of the nose primer and of the explosive column 14 providing the pyrotechnic transmission, ignition cannot be transmitted to the booster 22, since the cylindrical bolt 27 blocks the axial duct 19 transversally until the projectile has been fired. The bolt 27 therefore really does form a physical obstacle for the directional metal particles thrown through the duct 19 towards the booster 22.

I claim:

1. An armour-piercing high-explosive projectile comprising a body portion attached to a cartridge case, a nose portion including a nose fuse affixed to said body portion and means on said body portion for engaging a rifled gun barrel and stabilizing the gyration of said projectile after said projectile has been fired, said body portion defining an inner chamber containing a secondary stabilized explosive material mounted about an empty duct having a forward end and a rearward open end, said inner chamber having its end closest to said nose portion defined by a slightly conical liner element forming a flat charge, said liner element having a central opening receiving said forward open end of said duct, said rearward open end of said duct communicating with said secondary explosive material, centrifugal safety means within said duct for blocking passage of solid particles through said duct before firing of the projectile, said nose portion enclosing along its longitudinal axis a hollow tubular sheath element having a forward open end and a rearward end fitted with a metal closing element, said hollow tubular sheath being fitted with a secondary stabilized explosive material in contact with said metal closing element and forming an explosive column, said explosive column being in axial alignment with said empty duct and having its rearward end near the forwrad end of said duct, said metal closing element having a concave surface facing said forward open end of said duct, said nose fuse comprising a primer of primary explosive material within said tubular sheath whereby pieces of said metal closing element are thrown through said duct and impact said stabilized explosive material contained in said inner chamber causing said material to explode, said centrifugal safety means unblocking said duct due to centrifugal force applied to said safety means.

2. The projectile as defined in claim 1 wherein said centrifugal safety means include a collar disposed about said empty duct, said collar defining a radial cavity in communication with said duct, a bolt slidable within said cavity, a spring within said cavity urging said bolt into blocking position within said duct to prevent any passage through the length of said duct, said bolt adapted to slide within said radial cavity and away from said duct upon firing and gyration of the projectile due to the centrifugal force of said projectile gyration so as to unblock said duct.

3. The projectile as defined in claim 2 wherein said bolt, when in its duct blocking position, has its center of gravity on the same side of the projectile center line as said radial cavity.

4. The projectile as defined in claim 3 wherein said collar disposed about said empty duct is an annular collar affixed to said duct, said collar provided with a plurality of weight-reducing holes.

5. The projectile as defined in claim 1 wherein said primer is mounted forwardly of said tubular sheath and in axial alignment with said sheath, a plate supported above said primer by deformable means spaced from said primer, said plate having a point element directed toward and spaced from said primer for subesquent engagement therewith on impact of said projectile and deformation of said deformable means.

6. The projectile as defined in claim 1 wherein said cartridge case is fitted with a primer of primary explosive material, said cartridge case having a propellant charge disposed therein, whereby said primer, upon being fired by the firing pin of a weapon, transmits its ignition to said propellant charge.

7. The projectile as defined in claim 1 wherein said body portion includes an end face sealing said body portion from said cartridge case, and a highly exothermic self destruct charge secured to the outside of said end face whereby, upon ignition, said charge heats said end face and said stabilized secondary explosive material within said body portion about said duct.

8. The projectile as defined in claim 1 wherein a rocket propulsion container containing a solid fuel propulsion unit is installed between said projectile body portion and said cartridge case, said container having an exhaust nozzle on its rear portion, said exhaust nozzle having a convergent-divergent profile.

9. The projectile as defined in claim 1 wherein said solid fuel in said rocket propulsion container comprises an annular cake having a star-shaped center passage, a booster charge mounted adjacent said exhaust nozzle, whereby when said booster charge is ignited, its flames are transmitted through said star-shaped center passage to said solid fuel and igniting said fuel in said rocket propulsion container.

10. The projectile as defined in claim 1 wherein said nose portion includes a nose cap at the forward end of the projectile and said nose portion, said nose cap and said body portion of said projectile are made of a light metal.

11. An armour-piercing high-explosive projectile comprising a body portion attached to a cartridge case, a nose portion including a nose fuse affixed to said body portion and means on said body portion for engaging a rifled gun barrel and stabilizing the gyration of said projectile after said projectile has been fired, said body portion defining an inner chamber containing a secondary stabilized explosive material mounted about an empty duct having a forward open end and a rearward open end, said inner chamber having its end closest to said nose portion defined by a slightly conical liner element having a large vortex angle and forming a flat charge, said liner element having a central opening receiving said forward open end of said duct, said rearward open end of said duct communicating with said secondary explosive material, centrifugal safety means within said duct for blocking the passage of metal slivers through said duct before firing of the projectile, said centrifugal safety means including a collar disposed about said duct, a bolt slidable within said cavity, a spring within said cavity urging said bolt into blocking position within said duct to prevent passage of metal slivers through the length of said duct, said bolt adapted to slide witin said radial cavity and away from said duct upon firing and gyration of the projectile due to the centrifugal force of said projectile gyration so as to unblock said duct, said nose portion enclosing along its longitudinal axis a hollow tubular sheath element having a forward open end and a rearward end fitted with a metal closing element, said hollow tubular sheath being fitted with a secondary stabilized explosive material in contact with said metal closing element and forming an explosive column, said explosive column being in axial alignment with said empty duct and having its rearward end near the forward end of said duct, said metal closing element having a concave surface facing said forward open end of said duct, said metal closing element shattering into a plurality of metal slivers entering said forward open end of said duct upon the explosion of said explosive column, said nose fuse comprising a primer of primary explosive material capable on impact of igniting said secondary explosive material within said tubular sheath, said tubular sheath extending from said primer to a point adjacent to and forward of the forward open end of said duct.

12. The projectile as defined in claim 11 wherein a primer booster comprising a stabilized secondary explosive material is disposed adjacent said rearward open end of said duct, whereby metal splinters passing through said duct and striking said stabilized secondary explosive material ignite said material which, in turn, ignites said explosive material mounted about said duct.

13. The projectile as defined in claim 12 wherein said secondary stabilized explosive material mounted about said empty duct consists of a pair of annular-shaped cakes of high explosive material stacked about said duct.

14. The projectile as defined in claim 13 wherein said pair of annular shaped cakes of high explosive material stacked about said duct are partly separated by said collar disposed about said duct.

15. The projectile as defined in claim 11 wherein said primer is mounted forwardly of said tubular sheath and in axial alignment with said sheath, a plate supported above said primer by deformable means spaced from said primer, said plate having a point element directed toward and spaced from said primer for subsequent engagement therewith on impact of said projectile and deformation of said deformable means.

16. The projectile as defined in claim 11 wherein said cartridge case is fitted with a primer of primary explosive material, said cartridge case having a propellant charge disposed therein, whereby said primer, upon being fired by the firing pin of a weapon, transmits its ignition to said propellant charge.

17. The projectile as defined in claim 11 wherein said body portion includes an end face sealing said body portion from said cartridge case, and a highly exothermic self destruct charge secured to the outside of said end face whereby, upon ignition, said charge heats said end face and said stabilized secondary explosive material within said body portion about said duct.

18. The projectile as defined in claim 11 wherein a rocket propulsion container containing a solid fuel propulsion unit is installed between said projectile body portion and said cartridge case, said container having an exhaust nozzle on its rear portion, said exhaust nozzle having a convergent-divergent profile.

19. The projectile as defined in claim 11 wherein said solid fuel in said rocket propulsion container comprises an annular cake having a star-shaped center passage, a booster charge mounted adjacent said exhaust nozzle, whereby when said booster charge is ignited, its flames are transmitted through said star-shaped center passage to said solid fuel and igniting said fuel in said rocket propulsion container.

20. The projectile as defined in claim 11 wherein the outer edge of said nose portion has a plurality of axial milled slots thereon, said slots slowing down by aerodynamic action the rotation of said projectile during its flight.

21. The projectile as defined in claim 11 wherein said nose portion includes a nose cap at the forward end of the projectile and said nose portion, said nose cap and said body portion of said projectile are made of a light metal.

22. The projectile as defined in claim 10 or 21 wherein said light metal is magnesium.

23. An armour-piercing high-explosive projectile comprising a body portion attached to a cartridge case, a nose portion including a nose fuse affixed to said body portion and means on said body portion for engaging a rifled gun barrel and stabilizing the gyration of said projectile after said projectile has been fired, said body portion defining an inner chamber containing a secondary stabilized explosive material mounted about an empty duct having a forward open end and a rearward open end, said inner chamber having its end closest to said nose portion defined by a slightly conical liner element forming a flat charge, said liner element having a central opening receiving said forward open end of said duct, said rearward open end of said duct communicating with said secondary explosive material, centrifugal safety means within said duct for blocking any passage through said duct before firing of the projectile, said nose portion enclosing along its longitudinal axis a hollow tubular sheath element having a forward end and a rearward end fitted with a metal closing element, said hollow tubular sheath being fitted with a secondary stabilized explosive material in contact with said metal closing element and forming an explosive column, said explosive column being in axial alignment with said empty duct, said nose fuse comprising a primer of primary explosive material capable on impact of igniting said secondary explosive material within said tubular sheath, said primer mounted forwardly of said tubular sheath and in axial alignment with said sheath, a collar supported above said primer by deformable means spaced from said primer, said collar having a point element directed toward and spaced from said primer for subsequent engagement with said primer on impact of said projectile, said collar provided with a cavity extending substantially through its axial length and having a thin connecting zone between said point element and the axially extending body of said collar, an axial bar of hard material disposed within said collar cavity collar, whereby on impact of said projectile said bar shears said thin connecting zone of said collar and drives said point element to strike said primer.

24. An armour-piercing high-explosive projectile comprising a body portion attached to a cartridge case, a nose portion including a nose fuse affixed to said body portion and means on said body portion for engaging a rifled gun barrel and stabilizing the gyration of said projectile after said projectile has been fired, said body portion defining an inner chamber containing a secondary stabilized explosive material mounted about an empty duct having a forward open end and a rearward open end, said inner chamber having its end closest to said nose portion defined by a slightly conical liner element forming a flat charge, said liner element having a central opening receiving said forward open end of said duct, said rearward open end of said duct communicating with said secondary explosive material, centrifugal safety means within said duct for blocking the passage through said duct before firing of the projectile, said centrifugal safety means including a collar disposed about said duct and defining a radial cavity in communication with said duct, a bolt slidable within said cavity, a spring within said cavity urging said bolt into blocking position within said duct to prevent passage through the length of said duct, said bolt adapted to slide within said radial cavity and away from said duct upon firing and gyration of the projectile due to the centrifugal force of said projectile gyration so as to unblock said duct, said nose portion enclosing along its longitudinal axis a hollow tubular sheath element having a forward open end and a rearward end fitted with a metal closing element, said hollow tubular sheath being fitted with a secondary stabilized explosive material in contact with said metal closing element and forming an explosive column, said explosive column being in axial alignment with said empty duct, said metal closing element having a concave surface facing said forward end of said duct, said metal closing element shattering into a plurality of metal slivers entering said forward open end of said duct upon the explosion of said explosive column, said nose fuse comprising a primer of primary explosive material capable on impact of igniting said secondary explosive material within said tubular sheath, said tubular sheath extending from said primer to a point adjacent to and forward of the forward open end of said duct, said primer mounted forwardly of said tubular sheath and in axial alignment with said sheath, a collar supported above said primer by deformable means spaced from said primer, said collar having a point element directed toward and spaced from said primer for subsequent engagement with said primer on impact of said projectile, said collar provided with a cavity extending substantially through its axial length and having a thin connecting zone between said point element and the axially extending body of said collar, an axial bar of hard material disposed within said collar cavity, whereby on impact of said projectile said bar shears said thin connecting zone of said collar and drives said point element to strike said primer.

* * * * *